US007354539B2

(12) United States Patent
Benedetti

(10) Patent No.: US 7,354,539 B2
(45) Date of Patent: Apr. 8, 2008

(54) PROCESS FOR GLUING WOOD FRAGMENTS OR CHIPS FOR SEMI-FINISHED WOOD PANELS AND RELATIVE GLUING APPARATUS

(75) Inventor: Paolo Benedetti, S. Damaso (IT)

(73) Assignee: Imal S.r.l, S. Damaso (Modena) (IT)

( * ) Notice: Subject to any disclaimer, the term of this patent is extended or adjusted under 35 U.S.C. 154(b) by 308 days.

(21) Appl. No.: 11/135,463

(22) Filed: May 24, 2005

(65) Prior Publication Data

US 2005/0263917 A1 Dec. 1, 2005

(30) Foreign Application Priority Data

May 25, 2004 (IT) ..... MO2004A0127

(51) Int. Cl.
*B27N 1/02* (2006.01)

(52) U.S. Cl. ..... 264/40.4; 264/109; 118/303; 156/64; 427/212

(58) Field of Classification Search ..... None
See application file for complete search history.

(56) References Cited

U.S. PATENT DOCUMENTS

| | | | | |
|---|---|---|---|---|
| 4,390,285 A | | 6/1983 | Durr et al. | |
| 4,862,826 A | * | 9/1989 | Christen | 118/303 |
| 5,792,264 A | * | 8/1998 | Frati | 118/303 |
| 6,409,834 B1 | * | 6/2002 | Frati | 118/303 |
| 2003/0127763 A1 | * | 7/2003 | Stutz | 264/40.4 |
| 2004/0022936 A1 | * | 2/2004 | Benedetti | 427/207.1 |

FOREIGN PATENT DOCUMENTS

| | | | |
|---|---|---|---|
| DE | 41 15 047 | | 7/1992 |
| DE | 101 39 966 | | 2/2003 |
| DE | 203 17 633 | | 3/2004 |
| EP | 1 022 103 | | 7/2000 |
| GB | 791554 | * | 3/1958 |
| WO | WO 2005/035213 | | 4/2005 |

* cited by examiner

*Primary Examiner*—Mary Lynn Theisen
(74) *Attorney, Agent, or Firm*—Young & Thompson

(57) ABSTRACT

The process includes a weighing operation of a mass of material a glue is to be spread on, and thereafter a spraying operation of glue, variably mixed with steam, so that the glue is spread on the wood chips proportionately to a weight of the wood chips. The gluing process is completed in a resin bonder machine comprising a cylindrical body in which two different-diameter and oppositely-pitched helices are rotated to mix the glue and chips. Both the body and the helices are cooled in order to prevent adhesion of glued material thereon.

10 Claims, 2 Drawing Sheets

PROCESS FOR GLUING WOOD FRAGMENTS OR CHIPS FOR SEMI-FINISHED WOOD PANELS AND RELATIVE GLUING APPARATUS

BACKGROUND OF THE INVENTION

The prior art for gluing fragments and scales of wood for producing semi-finished wood panels includes the use of a special resin bonder machine which the wood chips are directed to, and in which the chips are mixed with the glue injected into the machine by special injectors.

The above-described machine is essentially constituted by a large cylindrical drum rotated about a horizontal axis thereof and internally provided with elements or similar components applied on the perimeter surfaces thereof in order to draw the wood fragments in rotation and to improve mixing.

These machines obviously have to be large, and need frequent and laborious maintenance and cleaning operations in order for the materials that deposit on the internal surfaces thereof to be removed, as these material accumulate between the elements and cause a progressive reduction of the mixing efficiency of the machine; there are also large masses of chip and glue to be detached and removed. Also, it is not possible to control the correct distribution of the glue throughout the wood materials and adjust the sprayers accordingly while the machine is operating, without first stopping the production process.

The main aim of the present invention is to provide a process for gluing scales, fragments and chips of wood, in which the distribution of the glue is optimised and the use of resin bonding machines of the above-described types is avoided.

A further aim of the invention is to provide an apparatus for gluing wood chips, scales and fragments in general, which obviates the above-described drawbacks in the prior art.

The above-cited aims and others besides are all attained with a process for gluing wood scales, fragments and chips in general, which process comprises:

- a continuous weighing stage of the chips which the glue is to be distributed in;
- a spraying stage of the glue on the wood chips, in a quantity which is proportional to the calculated weight, together with compressed air and/or steam in order to soften the wood chip, making the wood chip less fragile for the subsequent mixing stage;
- a material mixing stage using special machines made in such a way as to obtain an optimal distribution of the glue on the wood chips while at the same time preventing breakage of the chips and the adhesion of the above material to the various components of the machines, or in any case to make the machines easy to maintain.

The glue spraying operation is done using special injectors positioned at a hopper located at the outlet of the continuous weighing apparatus.

The process can advantageously include a stage in which the glue is injected under pressure, together with compressed air and/or water steam, using the same injectors or other dedicated injectors.

An apparatus for gluing wood scales, fragments and chips in general comprises means for continuously weighing the wood chips on exit thereof from relative storage tanks; at least a hopper provided with injectors of glue, and/or steam, the injectors being connected to relative pressurised supply plants; at least a resin bonder machine for completing the gluing process by mechanical mixing of the material.

The resin bonding machine comprises a cylindrical body in which two oppositely-pitched helices are rotated by a central horizontal shaft of the machine; the various components of the machine are internally cooled in order to prevent adhesion of the material thereon; the body can be opened to enable the maintenance operations of the machine.

The above-described characteristics clearly demonstrate the advantages of the machine of the invention with respect to prior-art resin bonders; in particular the machine offers advantages in reliability and practicality of use.

SUMMARY OF THE INVENTION

The process includes a weighing operation of a mass of material a glue is to be spread on, and thereafter a spraying operation of glue, variably mixed with steam, so that the glue is spread on the wood chips proportionately to a weight of the wood chips. The gluing process is completed in a resin bonder machine comprising a cylindrical body in which two different-diameter and oppositely-pitched helices are rotated to mix the glue and chips. Both the body and the helices are cooled in order to prevent adhesion of glued material thereon

BRIEF DESCRIPTION OF THE DRAWINGS

Other advantages of the present invention will better emerge from the detailed description that follows of a preferred but not exclusive embodiment of the invention, illustrated purely by way of non-limiting example in the accompanying figures of the drawings, in which.

DESCRIPTION OF THE PREFERRED EMBODIMENTS

Figure 1:
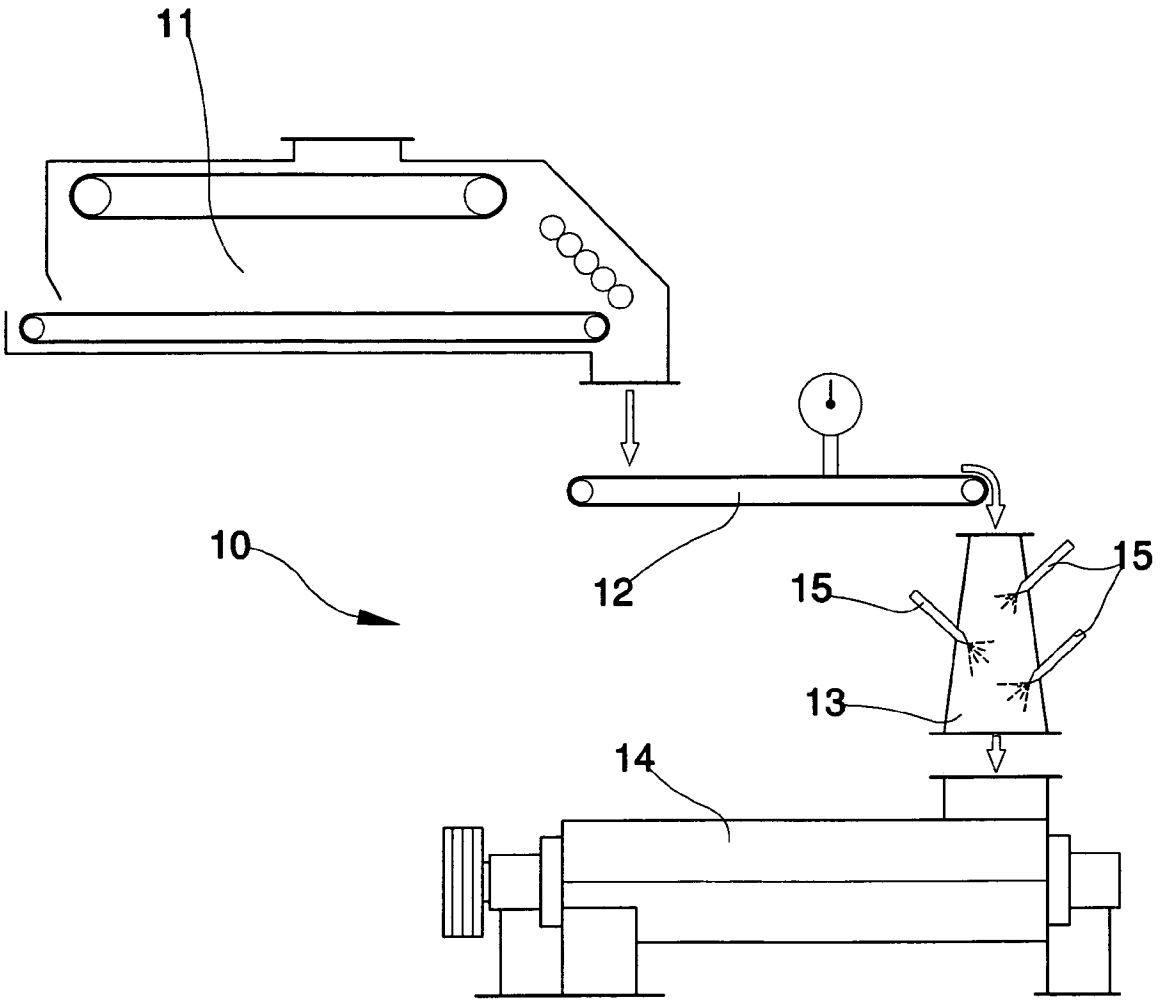
FIG. 1 is a schematic block diagram of a gluing apparatus according to the invention.

With reference to FIG. 1, 10 denotes in its entirety a gluing apparatus according to the invention, which is located at the exit of a tank 11 of wood scales, fragments and chips.

As can be seen from the figure, a belt weigher 12 is positioned so as to receive and weigh the material exiting from the tank 11. The belt weigher 12 transfers the material to a hopper 13, which connects the belt weigher 12 to a resin bonder 14 machine.

In the passage through the hopper 13, the wood chips are sprayed with a glue, distributed by special injectors 15 anchored to the perimeter surface of the hopper 13.

The quantity of glue injected through the injectors is specially controlled according to the readings taken by the belt weigher 12. The weight readings are transmitted in realtime to the injector control systems.

The process offers the possibility to visually control the glue and the possibility of intervening on the injectors during the production process, while the machine is operating.

In the described embodiment, at least one of the injectors 15 is supplied by a supply circuit of compressed air and/or steam, which is supplied contemporaneously with the glue, and is sent either to the same injector or to a discrete injector.

The wood chip is thus impregnated with the right quantity of glue, and is also added to the resin bonder 14 at a certain temperature. This is useful, as we shall see, for correct machine operation.

Figure 2:
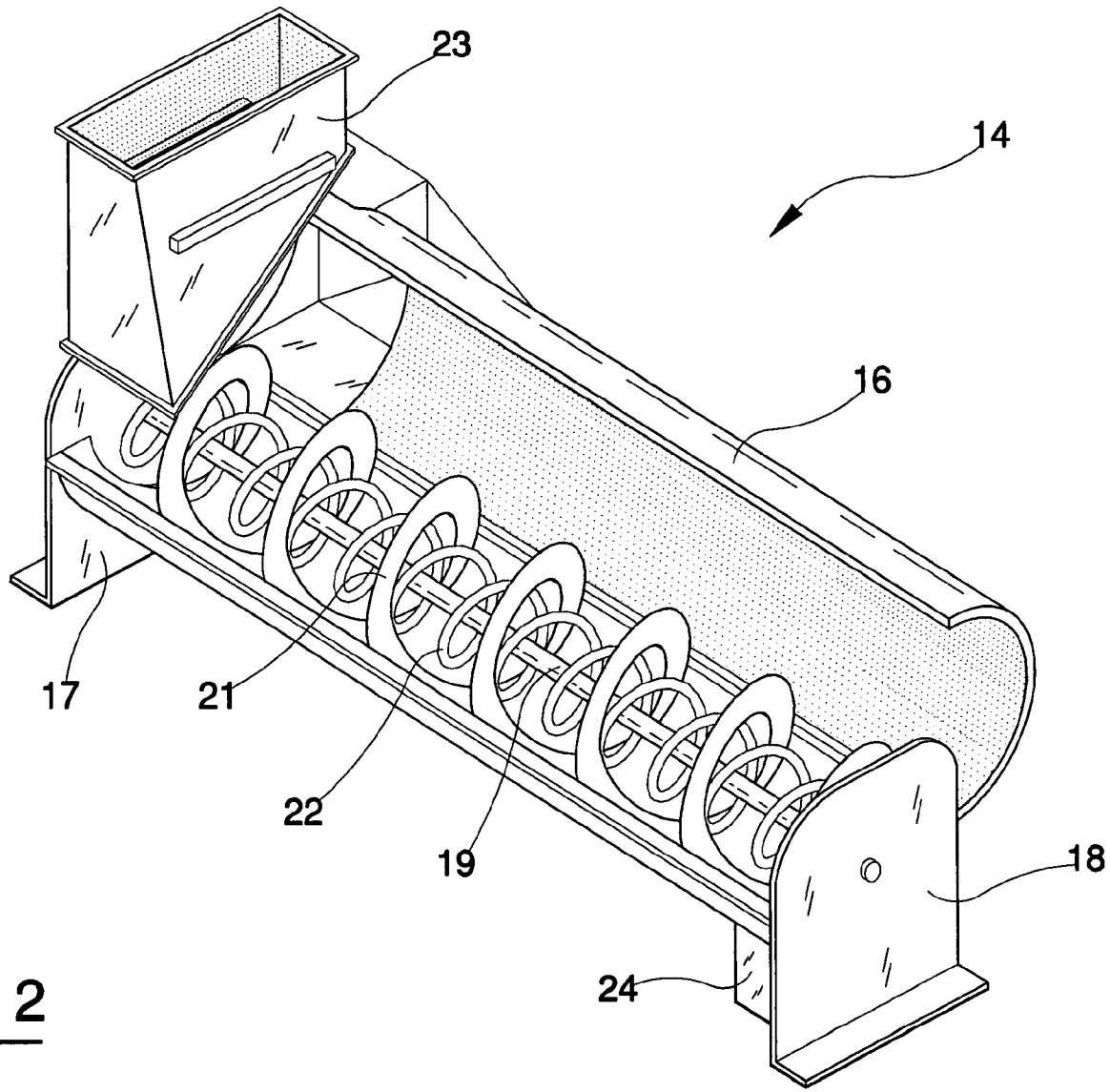
FIG. 2 is a three-dimensional view of a resin-bonding machine of the apparatus of FIG. 1.

The machine, as can be seen in FIG. 2, comprises a cylindrical body 16, having end surfaces 17, 18 which rotatably support ends of a horizontal shaft 19, to which two helices 21, 22 are constrained. The helices are of different diameter and opposite pitch. The two helices 21, 22 can also be blade or helical-segment shaped and opportunely positioned along the shaft 19.

The shaft 19 is rotated by a normal type of actuator, connected to an end of the shaft 19 by a suitable transmission element, as indicated in FIG. 1.

By effect of the rotation of the shaft 19, the material entering the machine 14 though the hopper 23 is mixed and progressively transferred towards the outlet 24 which is located at an opposite end of the machine 14.

The material stays longer than otherwise in the machine 14 during the mixing operation thanks to the known process of including two helices, of opposite pitch and one of smaller diameter than the other.

In this embodiment of the invention, the helices 21, 22, the shaft 19 and the body 16 are cooled by circulation of a coolant liquid internally of the shaft 19 and externally of the body 16. Because of the temperature of the material being mixed, a veil of condensation forms on the surface of the above-mentioned machine components. This moistness is useful in preventing material from sticking on the surfaces of the machine.

The helices 21, 22, when not of the shape represented in the figures of the drawings, i.e. when they are blade or helical segment shaped, and specially positioned along the shaft 19, can be cooled by circulation of coolant liquid. For easy machine maintenance, the body 16 is subdivided into two half-shells, hinged to one another at the horizontal central plane, in such a way as to enable an upper half-shell to be raised, affording access to the inside chamber of the machine for cleaning and maintenance purposes, without having to go to the length of accessing the whole internal workings of the machine.

Also, the accumulation of material along the various parts of the machine, and the consequent dirtying of the internal chamber are considerably reduced with respect to the prior art, thanks to the cooling of all the surfaces and components in contact with the chips.

Further, in comparison to the prior art, the reduction of size of the single wood fragments is considerably less, in fact it is almost eliminated, thanks to the injection of steam which enables the softening of the chip and thus renders it less fragile during the mixing phase, thanks also to the shape of the mixer tools, constituted especially in the present embodiment by blades tangentially invested by the material to be mixed, rather than by elements or pins which the wood chips strike against.

Obviously the above-described advantages are safeguarded even in the presence of modifications or variations to the above embodiment.

For example, the conformation of the various components of the apparatus of the invention might vary according to the specific application and the quantity of material averagely treated. The number and type of the injectors used might be varied, as well as the arrangement thereof in the glue spraying zone.

The resin bonder machine might have a different overall layout. The means for cooling too might be substituted, in terms of both type and arrangement.

What is claimed is:

1. A process for gluing wood scales, fragments and in general wood chips, wherein it comprises:

a weighing stage of the wood chips on which glue is to be distributed;

a glue spraying stage, including addition of compressed air and/or steam, onto the wood chips, in a quantity which is proportional to the weight of the wood chips;

a mixing stage of the wood chips and glue using a special machine, which machine is realised in such a way as to prevent adhesion of the wood chips and glue materials to various components of the machine;

wherein the glue spraying stage is performed by an injection thereof using control systems which are sensitive to chip load weights read during the weighing stage; and wherein the injection of glue is performed using injectors positioned at a hopper located at an outlet of the weighing apparatus.

2. The process of claim 1, wherein the weighing stage is performed using continuous weighing apparatus of the wood chips on which the glue is to be distributed.

3. The process of claim 1, wherein the glue is injected accompanied by water steam, which can be pressurised, and/or compressed air, which water steam and/or compressed air issues from the injectors or from dedicated further injectors.

4. An apparatus for gluing wood scales, fragments or in general chips, wherein it comprises: means for weighing the wood chips exiting from distribution tanks; at least a hopper equipped with glue injectors connected to pressurised supply plants; at least a resin bonder machine for completing a gluing stage by mechanical mixing of material exiting from at least a hopper.

5. The apparatus of claim 4, wherein the means for weighing comprise at least a belt weigher for continuous weighing of the wood chips.

6. The apparatus of claim 4, wherein the at least a hopper is also provided with injectors of steam and/or compressed air, which injectors can be the glue injectors or can be dedicated further injectors.

7. The apparatus of claim 4, wherein the resin bonder machine comprises a cylindrical body inside which two oppositely-pitched helices rotate together with a horizontal central shaft of the resin bonder machine.

8. The apparatus of claim 7, wherein the helices and the body are cooled by circulation of a coolant liquid.

9. The apparatus of claim 4, wherein the body is subdivided into two half-shells, hinged one to another, at a central horizontal plane, in order to enable an upper half-shell to be raised, so affording access to an internal chamber of the resin bonder machine.

10. The apparatus of claim 4, wherein the resin bonder machine comprises a cylindrical body inside which two oppositely-pitched helices are rotated by a central horizontal shaft of the resin bonder machine; in which the two oppositely-pitched helices are blade or helical-segment shaped, are opportunely positioned along the central horizontal shaft and can be cooled by circulation of refrigerant liquid.

* * * * *